United States Patent [19]

Forlenza

[11] 4,054,987

[45] Oct. 25, 1977

[54] CONSTRUCTION METHOD

[75] Inventor: Nicholas G. Forlenza, Utica, N.Y.

[73] Assignee: Mateflex/Mele Corporation, Utica, N.Y.

[21] Appl. No.: 661,725

[22] Filed: Feb. 26, 1976

[51] Int. Cl.[2] ..... B21D 39/00

[52] U.S. Cl. ..... 29/452; 52/227; 52/228; 272/3; 273/29 R

[58] Field of Search ..... 404/40, 41, 36; 428/53, 428/137; 52/100, 228, 591, 227; 272/3; 264/289; 29/452; 273/29 R

[56] References Cited

U.S. PATENT DOCUMENTS

| | | | |
|---|---|---|---|
| 2,415,830 | 2/1947 | Mack | 404/36 |
| 3,438,312 | 4/1969 | Becker et al. | 428/137 |
| 3,557,670 | 1/1971 | Sutton | 404/41 |
| 3,616,104 | 10/1971 | Kuzmick | 428/53 |
| 3,960,375 | 6/1976 | Roubi et al. | 404/41 |

*Primary Examiner*—Jay H. Woo

*Attorney, Agent, or Firm*—Kane, Dalsimer, Kane, Sullivan and Kurucz

[57] ABSTRACT

The disclosure is of a novel method for constructing a recreational ball-playing court surface from a plurality of square, unitary, elastic, molded thermoplastic sheets having a plurality of support legs and means for interlocking the sheets together. The sheets are divided into square gratings. The method of the invention comprises assembling the sheets together under tension along the horizontal axes of the sheets. The construction of the court surface according to the method of the invention obviates buckling of the surface due to thermal expansion of the sheets.

2 Claims, 7 Drawing Figures

CONSTRUCTION METHOD

BACKGROUND OF THE INVENTION

1. Field of the Invention

The invention relates to thermoplastic surfaces for ball playing courts and more particularly relates to methods of their construction.

2. Brief Description of the Prior Art

The construction of thermoplastic recreational surfaces has been described in the prior art; see for example U.S. Pat. Nos. 3,174,411; 3,438,312; and 3,616,104. Where the recreational surface is constructed from a plurality of thermoplastic building units and the surface area is substantial, the surface will naturally expand and contract along its horizontal axes to a significant degree, in response to temperature changes. The difficulty arises in those instances where it is desired to anchor the surface to prevent shifting of its position. When anchored and then subjected to a temperature increase, the expansion of the total structure may cause buckling of the surface. By the method of our invention, this problem is obviated and the potential for buckling of the surface obviated.

SUMMARY OF THE INVENTION

The invention comprises in the method of constructing a recreational, ball-playing court surface from a plurality of square, unitary, elastic, molded thermoplastic sheets having a plurality of support legs on the lower side thereof and means for interlocking said sheets together disposed about the periphery of said sheets, said sheets being divided into secondary squares comprising gratings defining a plurality of square shaped openings through said sheets, which comprises; interlocking said sheets together to form said court surface and anchoring the periphery of the surface formed to an underlying support surface, the improvement which comprises; tensioning said surface along its horizontal axes.

DETAILED DESCRIPTION OF THE INVENTION

As an example of a recreational, ball-playing court, the regulation tennis court has a length of 78 feet and a width of 27 feet (singles court) or 36 feet (doubles court). In addition to providing a court surface of these dimensions, it is often desirable to extend the recreational surface to provide peripheral alleys and walkways. Heretofore, court and ancillary surfaces have been provided by first constructing a bituminous or concrete base or support surface. The support surface is then covered with a thermoplastic recreational or playing surface such as that described in U.S. Pat. No. 3,438,312. The latter surface comprises an assembly of molded synthetic resin squares having a specific structure. The recreational surfaces of U.S. Pat. No. 3,438,312 and like surfaces have been particularly advantageous for tennis courts and may be employed without fastening to the supporting or base surface. However, it is desirable to fasten at least the periphery of such surfaces to prevent their shifting from a given position.

Figure 1:
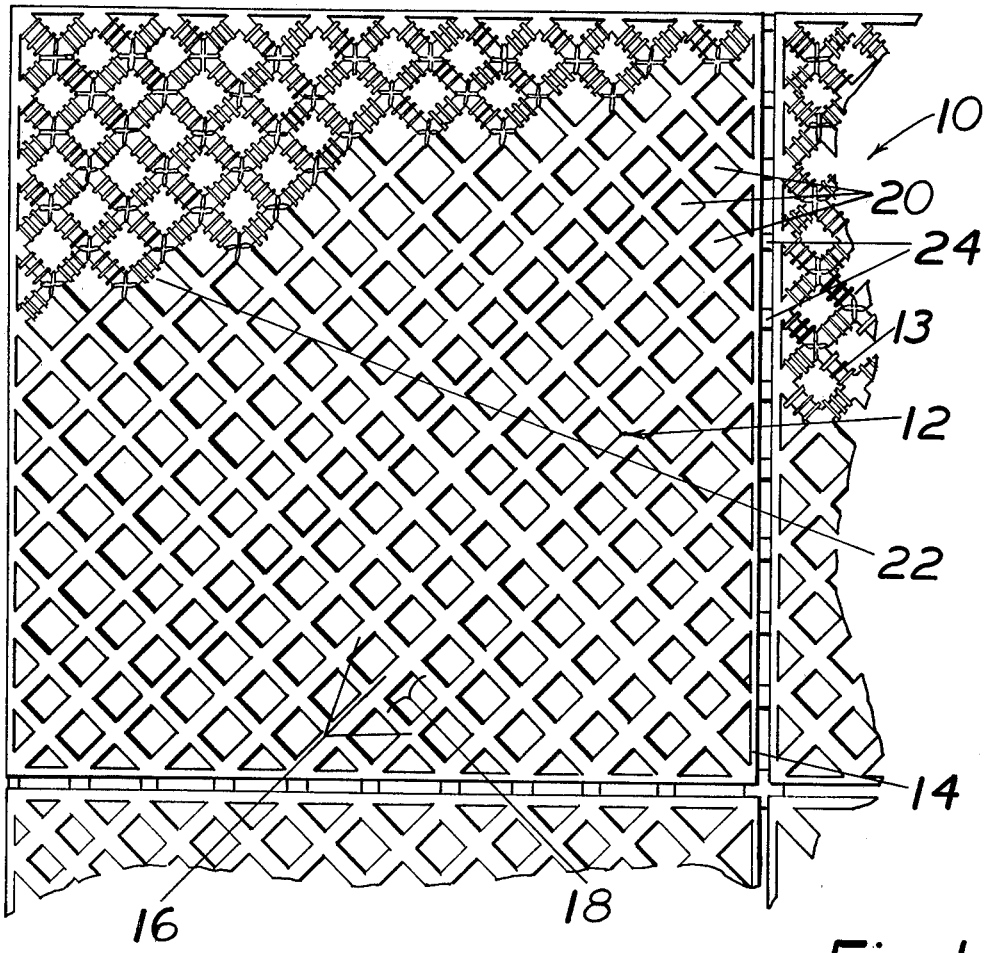
FIG. 1 is a view-from-above of a portion of a thermoplastic sheet construction element of a tennis court surface.

In carrying out the preferred method of the invention, there is first provided a sufficient number of square, unitary, elastic, molded polyethylene sheets to cover about 97.6 percent of the area of the desired recreational playing surface (calculated at 70° F without tensioning the sheets). Referring to FIG. 1, there is seen a view from above of a portion of a molded polyethylene sheet construction element for fabricating a tennis court. The sheet 10 is a unitary construction of a molded thermoplastic polyethylene presenting a square configuration, preferably of a dimension of about 0.327 meters square. The sheet 10 is sub-divided into 16 gratings 12 which comprise a square frame 14 traversed by a plurality of parallel bars 16 which are integral with parallel bars 18 travelling at right angles to bars 16. The bars 16, 18 form square openings 20 through the sheet 10. The openings 20 comprise about 25 to 55 percent of the total surface area of the sheet 10 and are squares of a dimension within the range of from about 3 mm to 30 mm square; preferably not more than about 15 mm square for a tennis court surface. Preferably the upper surface of the bars 16, 18 bear crosswise ribs 22 to provide a frictional upper surface. The elasticity of sheet 10 is obtained by the elastic connection 24 joining adjacent gratings 12, 13.

Figure 2:
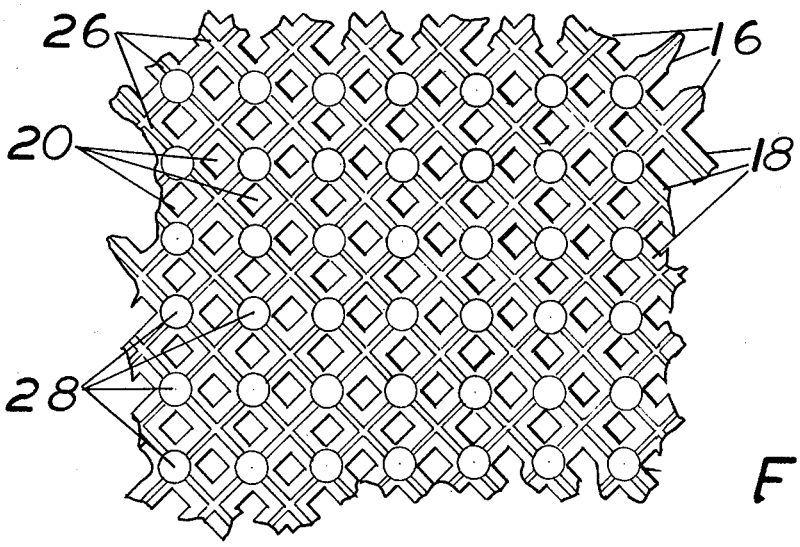
FIG. 2 is a view-from-below of a portion of the sheet seen in FIG. 1.

FIG. 2 is a view from below of a portion of the sheet 10 seen in FIG. 1, and shows in greater detail the grating formed by integrally molded bars 16, 18 defining square openings 20. At the alternate junctures of bar 16 with bar 18 there is seen a vertical, integrally molded support leg 28, cylindrical in shape and of a length of about ¼ inch to support the sheet 10 off a base surface. The leg 28 arrangement provides for a resilient overall sheet 10. The FIG. 2 also shows a lengthwise rib 26 integrally molded on the underside of each bar 16, 18 which serves to strengthen each bar 16, 18. The openings 20 contribute to the overall resiliency of each sheet 10 and also provide a means for drainage of water etc. from the upper surface of sheet 10.

Figure 3:
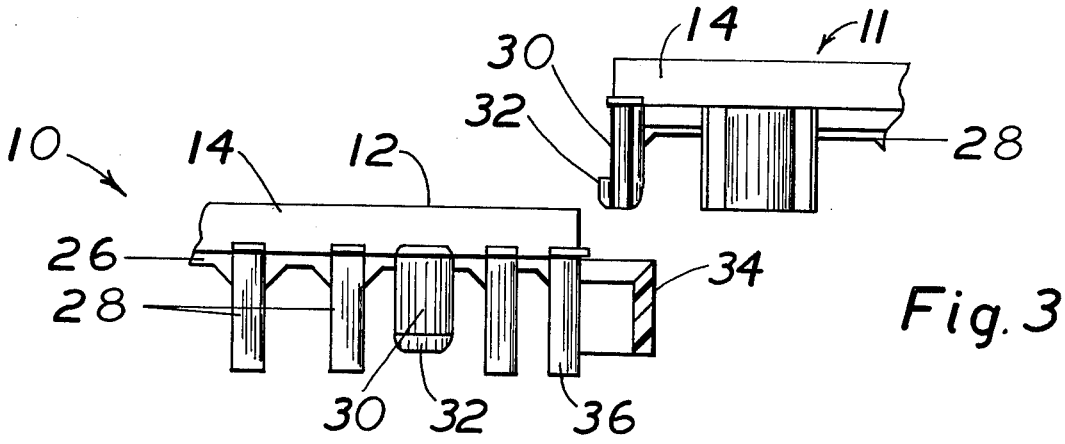
FIG. 3 is a side elevation of a corner of the sheet seen in FIG. 1 with a side elevation of an opposite edge of a similar sheet to show how the sheets are interlocked.

FIG. 3 is a side elevation of a corner of the sheet 10 seen in FIG. 1 with a side elevation of an opposite edge of a similar sheet 11 to show the means by which adjacent sheets 10, 11 are interlocked. The outer frame 14 of a corner grating 12 has integrally molded on one edge lug 30 bearing at its lower end detent 32. On an adjacent side, frame 14 has integrally molded thereon a coupling member 34 adapted to engage with lug 30 and detent 32 of an adjacent sheet 10 or 11 to provide an interlocking of adjacent sheets 10, 11. The coupling member 34 also serves as an additional support leg, having the same height as a leg 28. The lug 30 of one sheet together with the coupling member 34 constitute a means of unlockably interlocking the plurality of provided sheets 10. The detent 32 provides frictional engagement between the interlock members.

Figure 4:
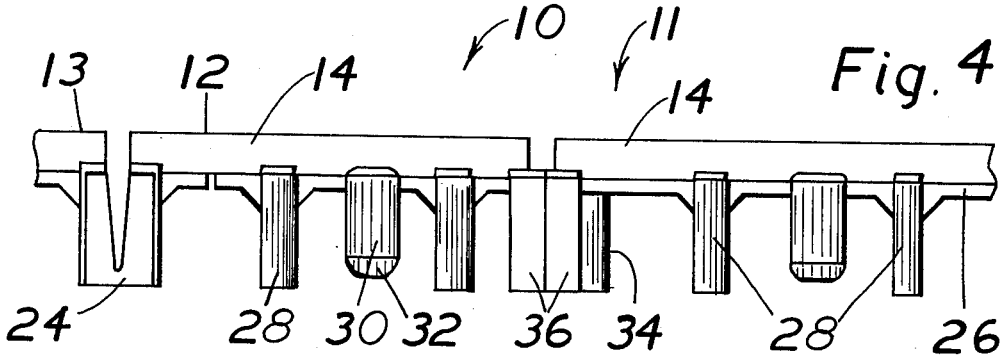
FIG. 4 is a side elevation of portions of two sheets as shown in FIG. 1 after interlocking but before tensioning.

FIG. 4 is a side elevation of the sheets 10, 11 after interlocking together so as to abut corner posts 36. FIG. 4 also shows elastic connection 24 between adjacent gratings 12 and 13. Elastic connection 24 is an integrally molded juncture between gratings 12 and 13 which will allow movement between the gratings 12, 13 when the sheet 10 is subjected to expansion or contraction due to thermal changes. As shown in FIG. 4, the interlocked sheets 10, 11 are at rest and not under tension.

Figure 5:
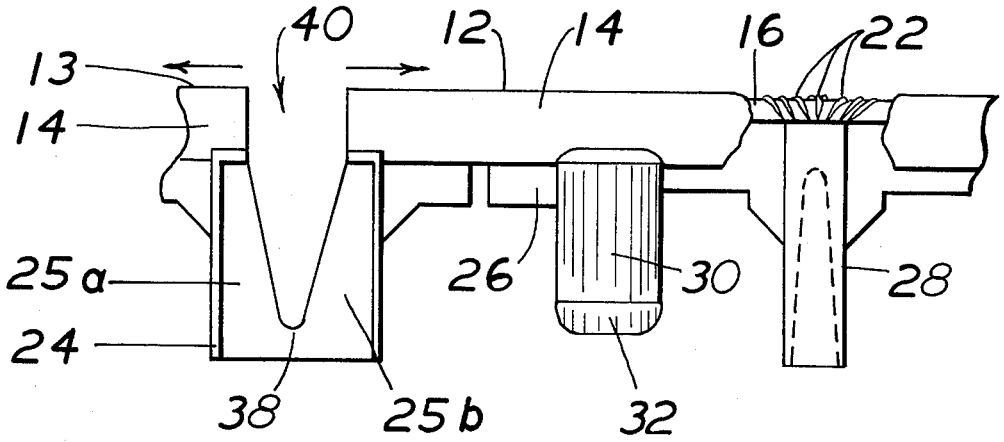
FIG. 5 is an enlarged side elevation with a portion cut-away, of a portion of the two gratings shown in FIG. 4, but after tensioning of the surface.

FIG. 5 is an enlarged side elevation with a portion cut-away, of a portion of the gratings 12, 13 seen in FIG. 4. FIG. 5 shows in greater detail the elastic connection 24 which comprises butts 25*a* and 25*b* which are integrally molded parts of the frame 14 of each of the respective gratings 12, 13. The butts 25*a* and 25*b* are joined at hinge pivot 38 so that the gratings 12 and 13 may move together to close gap 40 or may move apart to open gap 40. In the method of the invention, gratings 12, 13 are moved apart to tension the elastic connection 24 in the direction of the arrows. The elastic connection 24 is thus tensioned and urges closure of the gap 40. When under the influence of heat, the total surface of the assembled sheets 10 expands, such expansion is dissipated by the relaxation of tension in the elastic connection 24 thereby preventing complete closure of gap 40 and potential buckling of the assembled surface. FIG. 5 also shows in greater detail the structure of a support leg 28 which has a slightly truncated hollow cylindrical shape, the external diameter tapering downwardly and the internal diameter tapering upwardly. This shape provides an efficient resiliency in the recreational surface.

Essential to the improved method of the invention is tensioning of the assembled sheets 10 along the horizontal axes of the assembly in the direction of both the length and width of the sheets 10. The degree of tensioning is important and will depend upon the thermoplastic used to mold the sheets 10. The greater the coefficient for expansion of a given sheet material, the greater is the required degree of tensioning. For any specific material, the degree of tensioning may be calculated on the basis that tension should be maintained on the surface over a range of expansion for the given material resulting from a temperature increase of from about 65° F to about 120° F. In preferred tennis courts, the thermoplastic resin used to mold sheets 10 is polyethylene. Polyethylene sheets 10 as described above should be tensioned by stretching them to increase their linear dimensions by about 1.22 percent (at circa 70° F.). This degree of tension will dissipate any expansion due to ambient temperature increases up to about 120° F. In the preferred polyethylene sheets 10 described above being about 0.327 meters square, tensioning is to a degree to stretch the sheets 10 to a dimension of about 0.331 meters square.

In the simplest embodiment of the invention, the recreational surface such as a tennis court surface is constructed by interlocking together a sufficient number of the sheets 10 to cover about 97.6 percent of the desired court surface area. The court surface is advantageously assembled on a base or supporting surface of bitumin or concrete under ambient temperatures of circa 70° F. The assembled court surface is then tensioned by stretching in the lengthwise and widthwise directions to present 100 percent of the desired surface area and the periphery of the court surface is then anchored to the support surface. In this manner, each sheet 10 is stretched to increase its length and width by about 1.22 percent. The stretch occurs primarily in the elastic connection 24, opening gap 40. If the sheets 10 are assembled under substantially warmer conditions, ie; above about 85° F., the degree of stretching may be less to compensate for the expansion of the sheets 10 at the higher temperature.

Figure 6:
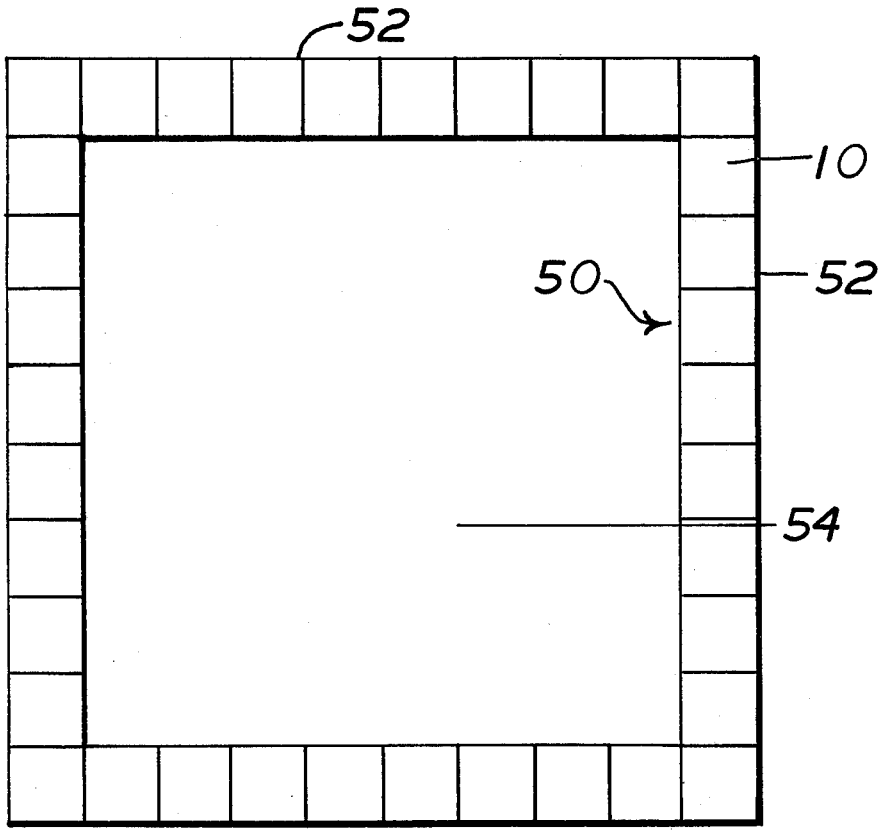
FIG. 6 is an assembly plan for constructing a tennis court from the sheets seen in FIG. 1 to a preferred method of the invention.
Figure 7:
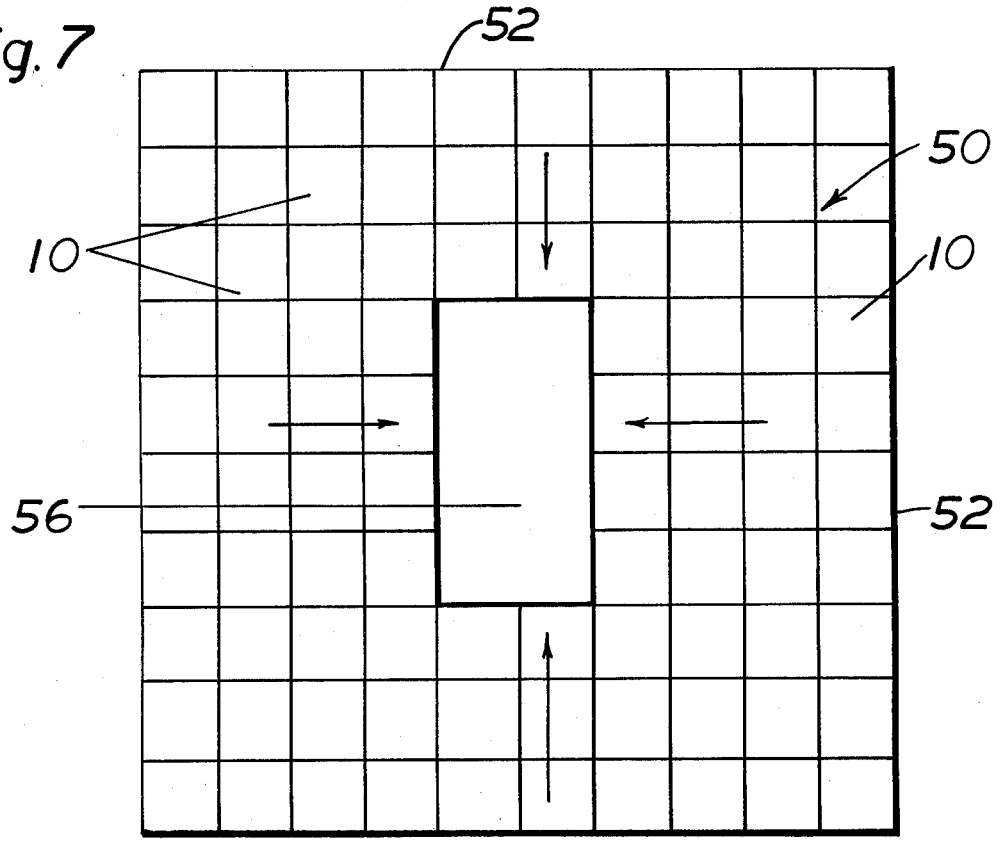
FIG. 7 is a view as in FIG. 6 but after further assembly.

In a preferred method of the invention, a sufficient number of polyethylene sheets 10 are provided to cover about 97.6 percent of the area of the desired court such as a tennis court (calculated on the basis of untensioned sheets at circa 70° F.). A portion of the sheets 10 are assembled and interlocked together as shown in FIG. 6 to form a peripheral margin 50 along the perimeter 52 of the desired court surface. The peripheral margin 50 is then anchored to the support surface 54 and the remainder of the provided sheets 10 assembled by interlocking them together and with the inner side of the peripheral margin 50 as seen in FIG. 7. As shown in FIG. 7, a center zone 56 is thereby left uncovered. The uncovered area comprises about 2.4 percent of the total court surface area. The court surface is then completed by pulling the assembled sheets together by stretching the assembly in the direction of the arrows as shown in FIG. 7 and interlocking the center sheets 10 at the midlines of the court. In this manner, the assembly of the court surface is completed and the whole court is under sufficient tension to dissipate any expansion due to thermal expansion of the court surface even up to about 120° F. Stretching of the court surface to interlock the center sheets 10 may be assisted by use of mechanical aids such as jacks, pulleys, etc.

It will be readily apparent to those skilled in the art that many modifications may be made to the method described herein without departing from the spirit of the invention. For example, sidelines or other markings may be incorporated in the recreational surfaces constructed by adding at appropriate positions, sheets other than sheets 10, ie; rectangles, hexagons, triangles and the like to establish a marking or a line pattern in the recreational surface.

What is claimed is:

1. In the method of constructing a recreational, ball-playing court surface from a plurality of square, unitary, elastic, molded thermoplastic sheets having a plurality of support legs on the lower side thereof and means for interlockng said sheets together, disposed about the periphery of said sheets, said sheets being divided into secondary squares comprising gratings defining a plurality of square shaped openings through said sheets, which comprises; interlocking said sheets together to form said court surface and anchoring the periphery of the surface formed to an underlying support surface, the improvement which comprises; tensioning said surface along its horizontal axes.

2. A method of constructing a tennis court surface from a plurality of square, unitary, elastic, molded polyethylene sheets having a plurality of support legs on the lower side thereof and means for interlocking said sheets together, disposed about the periphery of said sheets, said sheets being divided into secondary squares, each of said secondary squares comprising a grating defining a plurality of square shaped openings through said sheet, which comprises; (a) providing a sufficient number of said sheets to cover about 97.6 percent of the area of said tennis court when said sheets are interlocked and in an untensioned state; (b) interlocking together a portion of the provided sheets to form the peripheral margin of said tennis court; (c) anchoring the peripheral margin formed in step (b) to the underlying supporting surface, so that the outer edge of said tennis court surface is defined; (d) interlocking together the remainder of said sheets with each other and the inner side of said peripheral margin, whereby there is left a center zone uncovered by said court surface and comprising about 2.4 percent of the area of said tennis court; (e) stretching the interlocked sheets over said center zone; and (f) completing the interlocking of all sheets, whereby the tennis court surface is tensioned along is horizontal axes in the lengthwise and widthwise directions.

* * * * *